US005708757A

United States Patent [19]

Massaloux

[11] Patent Number: 5,708,757

[45] Date of Patent: Jan. 13, 1998

[54] METHOD OF DETERMINING PARAMETERS OF A PITCH SYNTHESIS FILTER IN A SPEECH CODER, AND SPEECH CODER IMPLEMENTING SUCH METHOD

[75] Inventor: Dominique Massaloux, Perros-Guirec, France

[73] Assignee: France Telecom, Paris, France

[21] Appl. No.: 635,760

[22] Filed: Apr. 22, 1996

[51] Int. Cl.[6] ..... G10L 9/00

[52] U.S. Cl. ..... 395/2.29

[58] Field of Search ..... 395/2.29, 2.28, 395/2.3, 2.32, 2.26

[56] References Cited

U.S. PATENT DOCUMENTS

| | | | |
|---|---|---|---|
| 5,060,269 | 10/1991 | Zinser | 395/2.29 |
| 5,105,464 | 4/1992 | Zinser | 395/2.29 |
| 5,195,168 | 3/1993 | Yong | 395/2.29 |
| 5,265,167 | 11/1993 | Akamine et al. | 395/2.29 |
| 5,327,520 | 7/1994 | Chen | 395/2.28 |
| 5,414,796 | 5/1995 | Jacobs et al. | 395/2.3 |

FOREIGN PATENT DOCUMENTS

WO 91/03790 3/1991 WIPO .

OTHER PUBLICATIONS

A. Gersho, "Advances in Speech and Audio Compression", *Proc. of the IEEE*, vol. 82, No. 6, Jun. 1994, pp. 900–918.

B. S. Atal et al., "Adaptive Predictive Coding of Speech Signals", *The Bell System Technical Journal*, Oct. 1970, pp. 1973–1986.

R. P. Ramachandran et al., "Stability and Performance Analysis of Pitch Filters in Speech Coders", *IEEE Transactions on Acoustics, Speech, and Signal Processing*, vol. 35, No. 7, Jul. 1987, pp. 937–946.

P. Kroon et al., "Pitch Predictor With High Temporal Resolution", *Proc. ICASSP*, vol. 2, Apr. 1990, pp. 661–664.

P. Vary et al., "Speech Codec for the European Mobile Radio System", Globecom, 1989, pp. 1065–1069.

W. B. Kleijn et al., "An Efficient Stochastically Excited Linear Predictive Coding Algorithm for High Quality Low Bit Rate Transmission of Speech", *Speech Communication*, vol. 7, No. 3, Oct. 1988, pp. 305–316.

*Primary Examiner*—Allen R. MacDonald
*Assistant Examiner*—Susan Wieland
*Attorney, Agent, or Firm*—Oliff & Berridge

[57] ABSTRACT

A long-term analysis of an input speech signal is carried out to adaptively select parameters of a pitch synthesis filter in respective variation ranges. Successively selected values of said parameters are processed to estimate maximum magnitudes of an error component of the output signal of the pitch synthesis filter. The variation range of at least one of said parameters is determined on the basis of the estimated maximum magnitudes.

10 Claims, 2 Drawing Sheets

METHOD OF DETERMINING PARAMETERS OF A PITCH SYNTHESIS FILTER IN A SPEECH CODER, AND SPEECH CODER IMPLEMENTING SUCH METHOD

TECHNICAL FIELD

The present invention relates to speech coding methods using long-term (LT) synthesis filters, also referred to as pitch synthesis filters. In particular, it concerns analysis-by-synthesis predictive speech coding.

BACKGROUND OF THE INVENTION

Predictive coding schemes form a large class of speech coding techniques that have been extensively used in modern digital communication and storage at low to medium bit rates. Those techniques are characterized by the use of linear prediction to estimate the current signal value from previously transmitted signal.

At the outset, only a short-term analysis related to the spectral shape of the input signal was performed. A long-term analysis was later provided for, in order to exploit the harmonic structure of voiced sounds. Then, the analysis-by-synthesis technique has been proposed to provide an efficient means to encode the excitation. A lot of well known coders were designed making use of this technique, such as the Multipulse coders, the large family of CELP (Code-Excited Linear Prediction) coders, or the SEV Coder (Self-Excited). See A. Gersho, "*Advances in Speech and Audio Compression*", Proc. of the IEEE, Vol. 82, n°6, June 1994, pages 900–918.

Generally, the speech synthesis scheme involves producing an innovative excitation (as a CELP codebook entry, or a combination of pulses . . . depending on the particular type of coder), filtering the innovative excitation by the LT or pitch synthesis filter (often implemented with an adaptive codebook), and then filtering the output of the LT synthesis filter by the short-term synthesis filter. The synthetized signal is obtained at the output of the short-term synthesis filter, and is sometimes subjected to post-filtering to improve subjective quality of the decoded speech. As used herein, the term "excitation" shall designate the output of the LT synthesis filter or the input of the short-term one, the term "innovative excitation" shall designate the input of the LT synthesis filter, and the term "long-term (LT) excitation" shall designate the difference between the excitation and the innovative excitation, in other words the contribution obtained from the adaptive codebook when an adaptive codebook design is employed.

The LT analysis at the encoder and LT synthesis at the decoder have followed the above-discussed evolution. A brief summary of the methods encountered is given below:

Let us call P(z) the transfer function of the LT prediction filter and $H_{lt}(z)$ the one of the synthesis filter, given by:

$$H_{lt}(z)=\frac{1}{1-P(z)}$$

The simplest form of the long-term filter is the 1-tap LT filter, characterized by a gain term β and a delay T sometimes called pitch delay (see B. S. Atal and M. R. Schroeder, "*Adaptive Predictive Coding of Speech Signals*", BSTJ, October 1970, pages 1973–1986): $P(z)=\beta z^{-T}$. This was extended to the case of multi-tap filters, as proposed by R. P. Ramachadran and P. Kabal, "*Stability and Performance Analysis of Pitch Filters in Speech Coders*", IEEE Trans. on ASSP, Vol. 35, n° 7, July 1987, pages 937–946:

$$P(z)=\sum_{i=-k}^{k}\beta_i z^{-T-i}$$

where 2k+1 is the number of taps and $\beta_i$ the corresponding gains, and T is expressed as an integer in units of the sampling period.

It has sometimes been proposed to combine several multiples of the pitch delay T, as in the above-mentioned Atal and Schroeder's paper:

$$P(z)=\beta_1 z^{-T}+\beta_2 z^{2T}$$

Then, fractional delays have been introduced (see P. Kroon and B. S. Atal, "*Pitch Predictors with High Temporal Resolution*", Proc. ICASSP, Vol. 2, pages 661–664, April 1990) using oversampling and subsampling with interpolation filters, leading to:

$$P(z)=\beta\sum_{i=0}^{2I-1}p_\phi(i)z^{-(T-I+i)}$$

for a fractional delay (T+φ/D), using a resolution of 1/D (T integer), the weighting coefficients $p_\phi(i)$ being given by $p_\phi(i)=h_{inter}(iD-\phi)$, $0\leqq\phi\leqq D-1$ with hinter being the impulse response of the interpolation filter of length 2ID+1.

At the encoder, the long-term analysis that determines the LT parameters on subframes of signal can take several forms. Formerly, it was performed in an open loop process on the input speech signal or on the short-term innovative. Then it has been proposed to apply a closed loop process to the past synthesized excitation signal (see, e.g., P. Vary et al's paper, "*Speech Codec for the European Mobile Radio System*", Globecom pages 1065–1069, 1989). Following the CELP approach, the now popular adaptive codebook method uses an analysis-by-synthesis scheme with a perceptual filtering to estimate the long-term parameters.

Closed loop schemes have introduced the need for an extrapolation to evaluate samples belonging to the current subframe when the LT delay is shorter than the subframe length (plus possibly some filter offset in the multi-tap or fractional case). Several strategies are adopted for such extrapolation. For a pitch delay T, a common approach (see W. B. Kleijn, D. G. Krasinski and R. H. Ketchum, "*An efficient Stochastically Excited Linear Predictive Coding Algorithm for High Quality low bit rate transmission of Speech*", Speech Comm. vol. 7, n° 3, pages 305–316, October 1988) is to replace each missing sample by an earlier sample of the preceding subframe, delayed by T by the lowest possible multiple of T. This extends to the case of fractional delays through the use of a recursive filling of the excitation with the fractional filtering (see International Patent Application n° PCT/US90/03625). Some authors also propose to fill an excitation buffer using the above-mentioned integer period T before applying the filter used in the multi-tap or fractional delay techniques (as in G723.1 ITU-T Recommendation). In the analysis, the search is sometimes simplified (as in G729 ITU-T Recommendation) by using the current residual signal instead of the missing excitation samples.

It is worthwhile to note that most analysis-by-synthesis coders allow the use of unstable long-term synthesis filters. This is for example the case for a 1-tap filter of the form $P(z)=\beta z^{-T}$, when the gain factor β is allowed to exceed 1.

Because analysis-by-synthesis introduces a local decoder at the encoder side, the coder controls the output of the LT filter. Hence, the use of possibly unstable filters is normally not too risky. It is well established that such possibility clearly improves the quality of decoded speech signals, at the onset of voiced periods for instance. However, a problem may arise when the innovative excitation produced at the distant decoder is not aligned any more with the one expected at the encoder. This may happen, e.g., when the transmission is disturbed by errors, or when the decoder arithmetic is different from the encoder one.

Then, for each sample at the decoder side, the innovative excitation signal is altered by a disturbance signal, that is filtered by the long-term synthesis filter. If a series of unstable filters has been selected, the difference between the encoder and decoder excitations may grow dramatically, which will cause the explosion of the excitation signal at the decoder. The selected pitch values have an impact on this phenomenon : clearly, if only a zone of the LT delay line, or a part of the adaptive codebook, has been disturbed, and if only samples outside the disturbed zone are involved in the next LT filterings, or only correct adaptive code vectors are selected, then the error will be forgotten. If, for instance, the pitch delays remain constant, all the samples of the delay line are reused which ensures the error propagation.

Note that the decoder output may explode well before the excitation exceeds the bounds defined by its arithmetics, due to the short-term synthesis filter that generally amplifies the error.

On speech signals, however, long series of unstable filters are quite unlikely and the pitch period generally varies.

By contrast, sine waves for instance are quite sensitive to the encoder-decoder mistracking. Therefore, the presence of pure frequency sounds in the audio signal to be coded represents a significant risk in a number of codec designs.

SUMMARY OF THE INVENTION

The present invention is used at the encoder side of a coding-decoding scheme comprising a long-term synthesis filtering, the use of a possibly unstable filter being allowed. The object of the invention is to prevent the explosion of the excitation when mistracking occurs between the encoder and the decoder, without substantially degrading the performance of the coding algorithm on normal pure speech.

According to the invention, there is provided a method of determining parameters of a pitch synthesis filter in a speech coder, comprising long-term analysis of an input speech signal to adaptively select said parameters in respective variation ranges, wherein successively selected values of said parameters are processed to estimate maximum magnitudes of an error component of an output signal of the pitch synthesis filter, and wherein the variation range of at least one of said parameters is determined on the basis of the estimated maximum magnitudes.

The estimates of the maximum error magnitude provide a basis for identifying the situations where the errors that may occur are likely to grow out of control and it is thus desired to promote the construction of a stable pitch synthesis filter. It is possible to simply preclude any unstable filter when an error indicator obtained from the estimated maximum error magnitudes exceeds a given threshold. A more gradual approach may also be taken, where the error indicator dynamically controls the variation range of one or more parameters of the pitch synthesis filter, such as tap gains.

In the typical case where the parameters of the pitch synthesis filter are determined for each one of a succession of subframes having a length of L digitized samples of the speech signal, a maximum magnitude of the error component may be estimated for each one of a succession of blocks of K samples, each subframe including a whole number (which may be 1 or L) of blocks. The appropriate choice of K is a tradeoff between the false alarm probability (which increases when K is increased) and the complexity of the error control procedure (which increases when K is reduced).

DETAILED DESCRIPTION OF PREFERRED EMBODIMENTS

Figure 1:
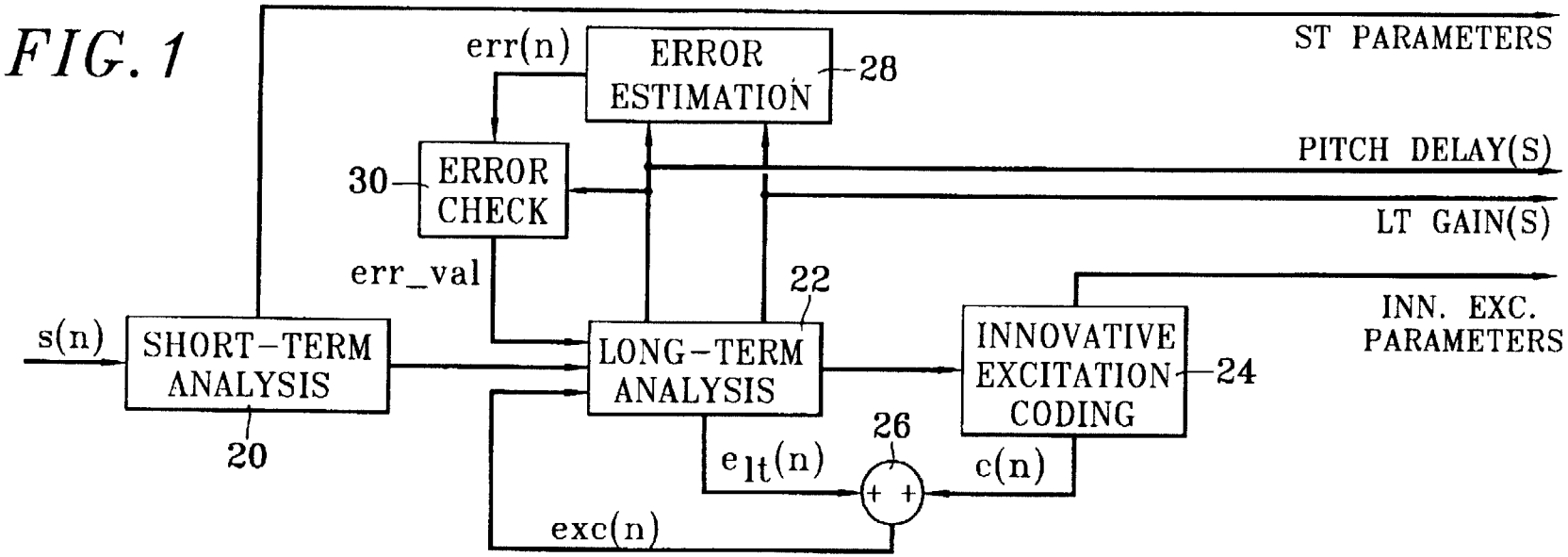
FIG. 1 is a block diagram of a speech coder in accordance with the present invention.

A general diagram of a speech coder incorporating the present invention is shown in FIG. 1. The coder is based on an analysis-by-synthesis predictive coding scheme, with a short-term analysis, a long-term analysis (that can be implemented by means of an adaptive codebook design) and any type of innovative excitation generation design (if any).

In FIG. 1, s(n) designates the input speech signal to be encoded. It is a digital signal obtained, e.g., by digitizing the output signal of a microphone with a sampling frequency of 8 kHz for instance. A module 20 performs a short-term linear prediction analysis of the input speech signal to produce short-term (ST) parameters forming a first type of output data of the coder. Suitable linear prediction methods usable in module 20 are well known in the art of audio coding. Reference may be had, e.g., to the book "Digital Processing of Speech Signals" by L. R. Rabiner and R. W. Shafer, Prentice-Hall Int., 1978. A set of ST parameters is typically produced for each one of a succession of L'-sample speech frames. That set is used at the decoder (FIG. 2), possibly after an interpolation as is usual in the art, to define a short-term synthesis filter 21 which will produce the synthetized speech signal $\tilde{s}(n)$.

Figure 2:
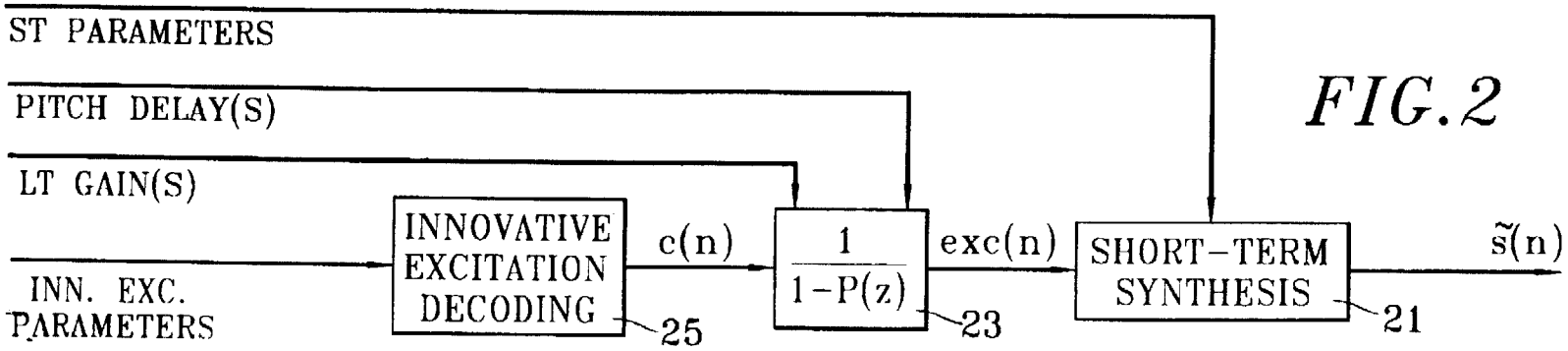
FIG. 2 is a block diagram of a corresponding decoder.

In FIG. 2, exc(n) stands for the excitation signal to be applied to the ST synthesis filter 21 to obtain the synthetized signal $\tilde{s}(n)$. It is a sum of a long-term (LT) excitation $e_{lt}(n)$ determined by a LT analysis module 22, and of an innovative excitation c(n) determined by an innovative excitation coding module 24, as symbolized by adder 26 in FIG. 1:

$$exc(n)=e_{lt}(n)+c(n) \tag{1}$$

The long-term excitation $e_{lt}(n)$ is obtained by filtering the past excitation exc(n) through a prediction filter of transfer function P(z). The transfer function thereby achieved between the innovative excitation c(n) and the excitation exc(n) is of the form $H_{lt}(z)=1/(1-P(z))$, defining a long-term synthesis filter 23 as shown in FIG. 2. This LT filter may be an unstable filter, as such possibility is known to generally improve the quality of the decoded speech.

The expression of P(z) depends of the particular LT technique adopted for the design of the speech codec. It may be any of the above-mentioned techniques, and it may be applied either directly to the input speech signal or to the 20 short-term residual. P(z) is given the general form:

$$P(z)=\sum_{i=0}^{k}\sum_{j=-p_i}^{q_i}\beta(i,j)\cdot z^{-Ti-j} \tag{2}$$

leading to the filtering equation:

$$e_{lt}(n)=\sum_{i=0}^{k}\sum_{j=-p_i}^{q_i}\beta(i,j)\cdot exc(n-T_i-j) \quad (3)$$

which involves k+1 pitch delays $T_i$ ($k\geqq 0$), and $p_i+q_i+1$ tap gains $\beta(i,j)$ for each pitch delay $T_i$. The case where $k=p_O=q_O=0$ is the case of the 1-tap, integer delay LT filter frequently discussed in the literature. The case where k=0 and all the tap gains $\beta(0,j)$ associated with the selected delay T are proportional to a single gain $\beta$ is encountered in the coders allowing fractional delays to be taken into account by an interpolation process.

The pitch delay(s) and the associated tap gain(s) form a second set of output data of the coder, which is used by the decoder to build to LT synthesis filter 23. That set is updated at each of a succession of L-sample subframes of the speech signal, each L'-sample frame being composed of one or several L-sample subframes or excitation frames.

Equation (3) may involve excitation samples belonging to the current subframe, i.e. that have not yet been calculated at the beginning of the current subframe. The derivation of the missing samples can be of any type, for instance one of those mentioned hereinabove.

Module 24 also determines the innovative excitation parameters on a subframe basis. Modeling of the innovative excitation may be of any type known in the art. For instance, in the case of a CELP coder, the innovative excitation parameters consist of a codebook entry index and an associated gain. In the case of a multipulse coder, they consist of pulse positions and amplitudes, and so forth . . . Those parameters are forwarded to the decoder where a corresponding innovative excitation decoding module 25 retrieves the relevant innovative excitation c(n).

If for each sample n, a disturbance $\delta(n)$ occurs in the production of c(n) at the decoder (due, for instance, to a transmission error or to a difference between the encoder and decoder arithmetics), the decoded excitation $exc_d(n)$ differs from the encoder excitation exc(n) by an error component that will be called excitation error $err_0(n)$:

$$\text{for every n, } exc_d(n)=exc(n)+err_0(n) \quad (4)$$

From equations (1) and (3), and taking the disturbance $\delta(n)$ into account, the excitation $exc_d(n)$ is given by $$exc_d(n)=\sum_{i=0}^{k}\sum_{j=-p_i}^{q_i}\beta(i,j)\cdot exc_d(n-T_i-j)+c(n)+\delta(n) \quad (5)$$

Hence, the excitation error signal $err_0(n)$ results from the filtering of $\delta(n)$ through $H_{lt}(z)$, according to the following equation:

$$err_0(n)=\sum_{i=0}^{k}\sum_{j=-p_i}^{q_i}\beta(i,j)\cdot err_0(n-T_i-j)+\delta(n) \quad (6)$$

The present invention proposes to derive, at the encoder side, an estimation err(n) related to the unknown excitation error signal $err_0(n)$. As shown in FIG. 1, an error estimation module 28 may provide the estimation err(n) for every sample. A buffer of M samples err(n) is then retained in memory. The size M of this buffer corresponds to the number of samples involved in producing one subframe of the LT excitation $e_{lt}(n)$, i.e. the LT delay line length. With equation (2), it may be obtained as $M=\max\{T_i+q_i, \text{ for } 0\leqq i\leqq k\}$.

The estimated excitation error signal err(n) is used in an error check module 30 to generate an error indicator err_val reflecting the potential error degree of the current excitation in the following way:

Before selecting any long-term filter, the estimated errors err(n) associated to the samples involved in the filtering procedure are determined. For a set of selected delays $\{T_i, i=0 \text{ to } k\}$, assuming that n=0 corresponds to the first sample of the current subframe, the maximum absolute value: $err_{max}=\max\{|err(n)|, \text{ for } -T_i-j\leqq n\leqq L-T_i-j-1,\ 0\leqq i\leqq k,\ -p_i\leqq j\leqq q_i\}$ is calculated. $err_{max}$ will have to be compared to one or several thresholds to determine the value err_val representing the degree of potential error on an absolute scale.

The error indicator err_val is used by a procedure designed to constraint the estimated excitation error signal err(n), that will be later referred to as "safety procedure". The derivation of err_val depends on the safety procedure that makes use of this indicator.

The purpose of the safety procedure is to keep the error signal limited and for this, it restricts the use of unstable filters when needed. The nature of this procedure depends on the kind of LT technique used, and of the quantization of the LT parameters, if any.

Evaluation of the estimated error signal err(n)

Since the safety procedure is activated during the LT analysis, the excitation error signal $err_0(n)$, or at least a maximum magnitude thereof, must be estimated at the encoder side, where the disturbance $\delta(n)$ is unknown.

For this, we represent the LT synthesis filter by a 1-tap recursive filter : if the multi-tap formulation or the fractional delay approaches have been chosen, it will be necessary to match the complex filter into a simpler 1-tap one. In the fractional delay case, the value of the integer delay T selected will be the nearest integer one. In the multi-tap case, a value of $\beta$ corresponding to the worst case (i.e. the largest value) will have to be determined.

With the one-tap filter, the long-term synthesis filter is defined by $$H_{lt}(z)=\frac{1}{1-\beta z^{-T}}$$

In this case, equation (6) reduces to: $err_0(n)=\beta err_0(n-T)+\delta(n)$.

Note that the computation of the missing samples (if needed) must follow the scheme used by the actual LT filter.

If we assume that $\delta(n)$ is bounded, i.e. $|\delta(n)|\leqq\Delta$, then $|err_0(n)|\leqq|\beta||err_0(n-T)|+\Delta$. Let err (n) be the signal obtained by filtering a constant signal ($=\alpha$, where $\alpha$ is some positive constant, for instance $\alpha=1$) with the 1-tap recursive filter representing the LT synthesis filter, i.e.:

$$err(n)=|\beta|err(n-T)+\alpha \quad (7)$$

err(n) initialized with $\alpha$'s.

Then, it can be shown that for each n:

$$|err_0(n)|.(\alpha/\Delta)\leqq err(n) \quad (8)$$

meaning that err(n) behaves as a worst-case bound for a signal proportional to $err_0(n)$. The problem that the actual disturbance $\delta(n)$ cannot be known by the coder can thus be circumvented by the use of err(n), which is an estimate of a maximum magnitude of the error component $err_0(n)$ contained in the output of the LT synthesis filter 23 at the decoder.

Equation (7) allows the computation of err(n) after the determination of each new set of LT parameters. The excitation error buffer will be updated after the selection and the quantization (if any) of the long-term parameters.

Simplification of err(n)

A variant of the invention is proposed here, reducing the complexity of the procedure both for the evaluation of err(n) and for the error check.

Since the codec operates on subframes of size L, the delay line of size M can be divided into $N_{blk}$ blocks of K samples. K is an integer which divides L. Equation (7) as commented hereabove corresponds to the case where K=1. A simplification of the error processing is obtained when K>1. The simplest form occurs when K=L. The size of the last block (corresponding to the oldest samples) can be less than K if M is not a multiple of K (see FIG. 3).

Instead of storing err(n) for the M samples of the delay line, only one value $err_b(i_{blk})$ is retained for all the samples of each block $i_{blk}=0, 1, \ldots, N_{blk}-1$.

Figure 3:
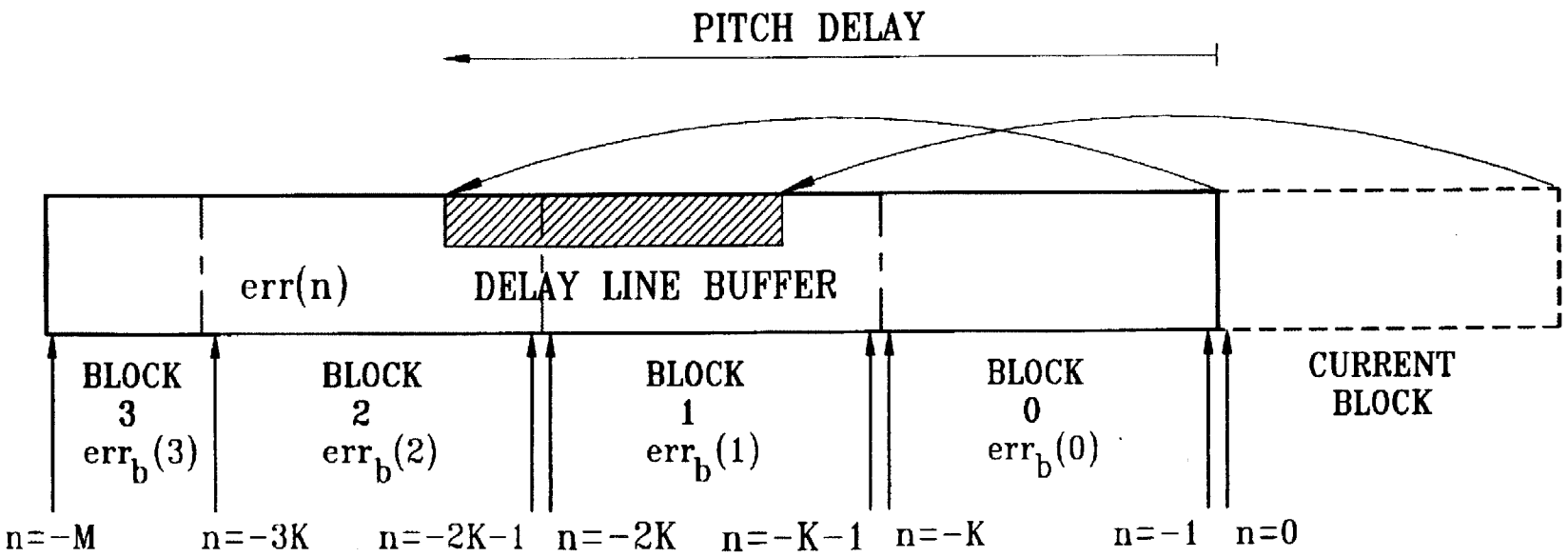
FIG. 3 is a diagram illustrating a blockwise error control procedure.

If n=0 corresponds to the first sample of the current block, then each block $i_{blk}$ contains the samples in the range $I(i_{blk})=[-Max((i_{blk}+1).K,M), -K.i_{blk}-1]$, with $i_{blk}=0$ to $N_{blk}-1$, as illustrated in FIG. 3 in a case where $N_{blk}=4$. The number of blocks $N_{blk}$ is equal to int(M/K), or int(M/K)+1 when M is not a multiple of K, int(x) denoting the integer part of x.

This reduces the storage of $err_b$ to the $N_{blk}$ values of $i_{blk}$.

When performing the error check, the blocks which include the samples concerned by the filtering are looked for, and only the errors associated with those blocks need to be tested. As an illustration, FIG. 3 shows, for a certain pitch delay selected with respect to the current block, that only blocks 1 and 2 are involved in calculating the LT excitation relating to the current block (hatched area).

Several strategies may be adopted for the determination of the values reflecting the block errors. Since the error function estimation given above is based on a worst-case computation, the following one is proposed:

$$err_b(i_{blk})=Max\{|err(n)|,\ n\in I(i_{blk})\}$$

which enables the maximum error magnitudes to be estimated according to a formula similar to equation (7).

Error check

The error check procedure consists in processing the maximum error magnitude estimates to derive the error indicator used to determine the variation range of one or more parameters of the pitch synthesis filter. During the selection of a new LT filter, the largest one of the maximum error magnitude estimates $err_{max}$ associated to all the samples involved in the filtering for a set of delays $\{T_i, i=0$ to $k\}$ is first calculated.

If the delay(s) $T_i$ and the coefficient(s) $\beta(i,j)$ are jointly optimized, it will be necessary to compute $err_{max}$ for every set of candidate delay(s) $\{T_i, i=0$ to $k\}$.

In the quite common case when the delay(s) are determined in a first step, and the filter coefficients quantized later, $err_{max}$ can be evaluated after the delay(s) selection. In this case, $err_{max}$ needs only to be calculated for the selected delay(s). Furthermore, only the LT gain(s) can have their variation range adapted based on the maximum error magnitude estimates. This simplifies the procedure but may tend to introduce some distortion, since the delay(s) selection has not taken the safety procedure into account. However, such distorsion will generally be acceptable.

Then, the error indicator err_val indicating the potential error degree on an absolute scale is determined. The derivation of err_val as a function of $err_{max}$ can take several forms and also depends on the safety procedure:

$err_{max}$ may be compared to a given threshold thresh that may be fixed or adapted, err_val taking the values 0 or 1 depending on whether $err_{max}$ exceeds thresh or not.

More generally, $err_{max}$ can be quantized in a given domain $[err_0, err_1]$, err_val being the quantization index of $err_{max}$. This allows a more flexible safety procedure.

The choice of the threshold or of the quantization bounds of $err_{max}$ to compute err_val depends on the environment in which the codec is running and on the error design that has been selected according to the present invention. In most cases they will be determined experimentally, from a large database, in such a way that the safety procedure is only activated for very "extreme" signals such as sine waves. There is a tradeoff between the safety level guaranteed by the present invention and the concern of the designer to avoid the safety procedure activation on most common signals.

According to formula (8), to keep the actual error $|err_0(n)|$ below a value thresh0, it is simply necessary to keep the estimated error |err(n)| below thresh0($\alpha/\Delta$). However, the estimation err(n) corresponds to a worst-case bound, i.e. to a systematic disturbance $\delta(n)=\Delta$. The actual disturbance signal will generally be well below its bounds, which is the case, e.g., when mistracking is caused by transmission errors. It may therefore be useful to increase the allowed range of err(n) so as to avoid too frequent false alarms.

Safety procedure

The method used to constrain the choice of the LT filters depend on the type of filters used. For example in the case of a 1-tap filter, the constraint will be placed on the value of the gain $\beta$, according to the fact that the larger values of $\beta$ lead to the higher excitation error increase. For multi-tap vector-quantized filters, a table where possible LT filters are ordered according to their capability of introducing larger excitation errors may be pre-computed, for instance.

The allowed domain of the LT filters is a function of err_val. Again there is a tradeoff between the safety level and the quality obtained: a too important restriction may yield very audible artifacts.

EXAMPLES

The invention is now described with reference to two particular embodiments. It should be understood that these are only examples of the present invention and that many changes can be brought to the without affecting the scope or spirit of the invention.

Example 1: ITU-T G729 coder

This invention has been introduced to prevent the explosion of the G729 coder, known from the ITU-T G729 Recommendation (see also International Patent Application PCT/FR96/00017 filed on Jan. 4, 1996, designating the USA, which is incorporated herein by reference). The G729 coder has the following features concerned by the present invention:

excitation subframes of length L=L_SUBFR=40 samples (the frame length being L'=80);

closed loop LT analysis, using a non uniform range of delays with fractional delays (resolution ⅓), and an interpolation filter $h_{inter}$ of size 61, leading to the following LT equation:

$$P(z) = \beta \sum_{i=-\lambda}^{\lambda-1} h_{inter}(\phi + 3i) z^{-t1-i}$$

for a pitch delay T=t1-Φ/3 (Φ=0,1 or 2, t1 integer), or, expressed otherwise : T=t0+t0_frac/3 (t0 being the closest integer to the pitch delay, and t0_frac=-1, 0 or +1). The parameter λ=L_INTER=10 controls the length of the interpolation filter. The LT gain β is >0, and the pitch delays are in the range [20−⅓, 145+⅓].

The present invention is implemented in the following manner:

Computation of the excitation error

The maximum magnitude of the excitation error signal is estimated according to equation (7), with the simplification previously described (K=L=40, i.e. one error computation block per subframe).

The delay line length is M=(145+1)+λ−1=155, which spans $N_{blk}$=4 blocks. An array of 4 blockwise excitation error magnitudes $err_b$ is kept in memory, and initialized with 1's. The block indices of this array are numbered from 0 to 3, with 0 indicating the last calculated block error and 3 the oldest one (as in FIG. 3).

For each subframe, after quantization of the LT gain, at the end of the subframe processing, the excitation error magnitude of the current block is evaluated as follows:

Two cases may happen:

(a) if t0<L:

Equation (7) involves samples of the current block. In the encoder, for the synthesis of the long-term excitation, the missing samples are recursively computed using the long-term synthesis equation (with gain=1). The estimated excitation error defined by equation (7) must follow a similar scheme.

The samples involved by equation (7) will then be of two types:

samples belonging to the preceding block ($i_{blk}$=0), samples recursively calculated using equation (7).

Since only one error magnitude value has been attributed to all the samples of the preceding block, only the two following error values have to be calculated:

$$err_1=\beta err_b(0)+1 \text{ and } err_2=\beta err_1+1$$

(alternatively $err_1$ and $err_2$ may be computed as $err_1=\beta err_b(0)+1$ and $err_2=err_1+1$), and the maximum error magnitude of the current block error will be assigned the worst one, i.e. Max{$err_1$, $err_2$}.

(b) else, if t0≦L:

The samples involved by equation (7) belong to the blocks zone1=int((t0-L)/L) to zone2=int((t0-1)/L).

The current block error value is then given by Max{β $err_b(i_{blk})$+1, for $i_{blk}$=zone1 to zone2} (in fact, $i_{blk}$ takes only two values at most).

Excitation error check

The testing of the excitation error is performed after the selection of the long-term delay. First the indices of the blocks containing the samples involved in the long-term synthesis are determined:

$$zone1=int(Max\{t1-(L+\lambda),0\}/L) \quad zone2=int((t1+X-2)/L)$$

Then $err_{max}$ is defined as the maximum of $err_b(i_{blk})$ for $i_{blk}$=zone1 to zone2, and if $err_{max}$>thresh, then err_val=1, else err_val=0.

A value of 60000 is used for thresh.

A C-language source code (floating representation) of the error estimation procedure (routine update_exc_err) and of the error check procedure, (routine test_err) is presented in Appendix I, where exc_err corresponds to the $err_b$ array, maxloc corresponds to $err_{max}$, and flag corresponds to the error indicator err_val.

Safety procedure

The following safety procedure is carried out when err_val=1. The LT gain used to compute the target vector in the fixed codebook selection is bounded by 0.95. Then, during the vector quantization of the long-term gain along with the fixed codebook gain, the constraint β<0.9999 is applied on the LT quantized gain value.

Example 2: ITU-T G723.1 coder

This invention has also been introduced in the G 723.1 coder, described in the ITU-T G723.1 Recommendation, jointly with a sine wave detection procedure, to avoid the possible explosions brought in the case of a mistracking between the encoder and the decoder. The sine wave detector provides instantaneous protection in the case of a sine wave in the frequency range [320, 3600] Hz. However, it fails in detecting sine waves outside this range where the present invention is still able to provide protection. The present invention is also likely to offer protection in the case of more complex signals also able to bring the algorithm into an unstable state. However, in the present invention, the safety procedure is only activated when the estimated error magnitude reaches a certain level. To avoid activation of this procedure on speech signals, it has been preferred to fix the threshold value at a relatively high level.

The G723.1 is a dual rate coder with 5.3 kbit/s as low rate and 6.3 kbit/s as high rate. It has the following features concerned by the present invention:

an open loop analysis is performed twice per frame (L'=240) prior to segmentation in subframes of length L=SubFrLen=60 samples, whereby an open loop pitch lag is determined for each subframe pair in a first step.

on each subframe, a 5-tap long-term filter is determined in closed loop, and vector-quantized. It is defined from the following LT prediction transfer function:

$$P(z) = \sum_{i=0}^{4} b_i^k \cdot z^{-T-i+2}$$

for the gain vector $b^k=\{b_i^k, 0 \leqq i \leqq 4\}$, the delays T being in the range [18,145].

the low rate uses a table of 170 possible gain vectors, and the high rate uses the same table and another table containing 85 additional gain vectors. In the latter case, each of the two tables may be used, depending of the value of T.

the closed loop delay range analysis is restricted to at most four delays T : the 1st and 3rd subframes restrict the search to X=3 values around the relevant open loop pitch lap (from lag-1 to lag+1) whereas the 2nd and 4th subframes use X=4 values in the neighbourhood of the pitch delay selected for the preceding subframe (from delay −1 to delay +2).

extrapolation of the missing samples: when T<62, prior to filtering, an excitation buffer exc'(n) is built from the past excitation samples exc(n) (n<0, with n=0 corresponding to the first sample of the present block) according to the following scheme:

$$exc'(n)=exc(n), \text{ for } -T-2 \leqq n \leqq -1$$

$$exc'(n)=exc(mod(n,T)-T) \text{ for } 0 \leqq n \leqq 61-T$$

mod(n,T) denoting the rest of the euclidian division of n by T.

The present invention is implemented in the following manner:

First, the 5-tap filters are converted into 1-tap filters assuming a worst-case strategy. Two tables of associated 1-tap pain values have been pre-computed for the 170 and 85 entries of the two gain vector tables according to the following scheme:

For a given vector $\bar{b}^k$, for each integer delay T, let f be the frequency in [0,4000 Hz] that maximizes the frequency response of the long-term filter 1/(1-P(z)). The gain value β(T) such that $$\frac{1}{1-\beta(T)} = \left| \frac{1}{1-\sum_{i=0}^{4} b_i^k z^{-T-i+2}} \right|$$

with $z=e^{2\pi jf/8000}$ is calculated (8000 Hz being the sampling frequency). Then for this vector $\bar{b}^k$, the associated 1-tap gain $\beta^k$ is given by the maximum of β(T), for T in [18,145]. Those gain values are computed once, and then stored in the error estimation module of the coder.

Computation of the excitation error

The excitation error magnitudes are estimated according to equation (7), the errors estimates being grouped into blocks of length K=30 (two blocks per subframe).

The delay line length is equal to 145+2=147, which spans 5 blocks of size 30. An array of 5 blockwise excitation error magnitudes $err_b$ is kept in memory and initialized with 1's. The block indices of this array are numbered from 0 to 4, with 0 indicating the last calculated block error and 4 the oldest one.

At the end of the subframe processing, two blockwise excitation error magnitudes are derived from the subframe long-term delay T and gain vector $\bar{b}$ in the 170-entry table or in the 85-entry one. The 1-tap gain β associated to $\bar{b}$ is first retrieved. Then, the current subframe is divided into 2 blocks of 30 samples, and the values $err_0$ and $err_1$ corresponding to samples respectively [30–59] and [0–29] are calculated in the following way:

Let p and q be defined by T=30p+q, $0 \leqq q \leqq 29$, $0 \leqq p \leqq 4$:

if q>0:

$err_0=Max\{1+\beta.err_b[Max(p-2,0)], 1+\beta.err_b[Max(p-1.0)])$ $err_1=Max(1+\beta.err_b[Max(p-1,0)],1+\beta.err_b(p)\}$ if q=0:

$err_0=1+\uparrow.err_b[Max\ (p-2,0)]$ $err_1=1+\beta \times err_b(p-1)$

The $err_b$ buffer is updated as follows:

$err_b(n)=err_b(n-2)$, $(2<n<Nblk-1)$, $err_b\ (0)=err_0$, $err_b\ (1)=err_1$.

Excitation error check

The testing of the excitation error magnitudes is performed during the long-term delay search procedure. As stated above, the closed loop search involves X=3 or 4 values, T+x for x=0, 1, . . . , X-1.

The following block indices are then computed:

zone1=int(Max(T-62,0)/30)

zone2=int ((T+X)/30)

then $err_{max}$ is defined as the maximum of $err_b(i_{blk})$ for $i_{blk}$=zone1 to zone2, and if $err_{max}$>Thresh_err then err_val=0.

Otherwise, the relative difference (Thresh_err -$err_{max}$)/Thresh_err is quantized using a uniform quantizer of step Pas. The error check output value err_val takes the quantization index value:

$$err_val = int\left(\frac{Thresh_err - err_{max}}{Thresh_err \cdot Pas}\right)$$

with Thresh_err=$2^{28}$ and Pas=1/128.

A C-language source code (floating representation) of the error estimation procedure (routine Update_err) and of the error check procedure (routine Test_err) is presented in Appendix II, where exc_err corresponds to the $err_b$ array, and itest corresponds to the error indicator err_val.

Safety Procedure

The value err_val is used to compute a bound in the gain vector quantization tables. Those tables have been ordered according to increasing values of the 1-tap associated gains $\beta^k$. This means that for both gain tables, the first filters are quite stable filters, able to introduce some leakage in the error signal, whereas the last filters are unstable filters that tend to boost the errors.

Minimum bounds in the tables have been chosen corresponding to the last stable filter: $N_{min}$=51 for the 85-entry table and 93 for the 170-entry one. Then the number N of gain vectors allowed in the search for each table is given by N=Min($N_{min}$+err_val x s', $N_{max}$) with $N_{max}$=85 or 170 and the step s' being respectively equal to 4 or 8. Then, in the selection of one of the X delays T+x jointly with the gain vector, the number of explored gain vectors is given by N.

APPENDIX I

```
/*** Constants ***/
#define L_SUBFR        40     /* Subframe length */
#define L_INTER        10     /* length/2 for interpolation filters */

/*************************************************************/
 * routine test_err - computes the accumulated potential error in the  *
 * adaptive codebook contribution                                      *
/*************************************************************/

int test_err(   /* (o) flag set to 1 if taming is necessary */
 int t0,        /* (i) integer part of pitch delay          */
 int t0_frac    /* (i) fractional part of pitch delay       */
)
    int i, t1, zone1, zone2, flag;
    float maxloc;

    t1 = (t0_frac > 0) ? (t0+1) : t0;

    i = t1 - L_SUBFR - L_INTER;
    if(i < 0) i = 0;
    zone1 = i/L_SUBFR;

    i = t1 + L_INTER - 2;
    zone2 = i/L_SUBFR;

    maxloc = -1.;
    flag = 0 ;
    for(i=zone2; i>=zone1; i—) {
        if(exc_err[i] > maxloc) maxloc = exc_err[i];
    }
    if(maxloc > thresh) {
```

APPENDIX I-continued

```
        flag = 1;
    }
    return(flag);
}

/*************************************************************
 *routine update_exc_err - maintains the memory used to compute   *
 * the error function due to an adaptive codebook mismatch between  *
 * encoder and decoder                                              *
 *************************************************************

int update_exc_err(
 float gain_pit,            /* (i) pitch gain */
 int t0                     /* (i) integer part of pitch delay */
)

    int i, zone1, zone2, n;
    float worst, temp;

    worst = -1.;

    n = L_SUBFR - t0;
    if(n > 0) {
        temp = 1. + gain_pit * exc_err[0];
        if(temp > worst) worst = temp;
        temp = 1. + gain_pit * temp;
        if(temp > worst) worst = temp;
    }

    else {
        i = -n;
        zone1 = i/L_SUBFR;

        i = t0 - 1;
        zone2 = i/L_SUBFR;

        for(i = zone1; i <= zone2; i++) {
            temp = 1. + gain_pit * exc_err[i];
            if(temp > worst) worst = temp;
        }
    }
    for(i=3; i>=1; i--) exc_err[i] = exc_err[i-1];
    exc_err[0] = worst;

    return;
}
```

APPENDIX II

```
/*
**
** File:      tame.c
**
** Description: Functions used to avoid possible explosion of the decoder
**              excitation due to series of long term unstable filters
**              and mistracking between the encoder and the decoder
**
** Functions:
**
** Computing excitation error estimation :
**       Update_Err( )
** Test excitation error
**       Test_Err( )
*/

/* Constants */
#define SubFrLen       60          /* Subframe length */
#define ClPitchOrd     5           /* Size of LT gain vectors */
#define SizErr         5           /* Size of exc_err */
#define Thresh_err     (double)(1 << 28)  /* threshold for exc_err */
#define Pas            (float)(1./128.)   /* step for exc_err Q */

#define SubFrLenS2     (SubFrLen/2)

static float exc_err[SizErr];
```

APPENDIX II-continued

```
/*
**
** Function:      Update_Err( )
**
** Description:   Estimation of the excitation error associated
**                to the excitation signal when it is disturbed at
**                the decoder, the disturbing signal being filtered
**                by the long term synthesis filters
**                Updates the array exc_err[ ]
**
**
** Arguments:
**
** Word16 Lag     pitch delay
** Word16 AcGn    Index of long term Gains vector
** float *tabgain Table of 1-tap associated gains
**                (tabgain85 or tabgain170)
**
**
*/
void Update_Err(
    Word16 Lag, Word16 AcGn, float *tabgain,
}
{
    Word16 i, iz;
    Word16 Lag;
    float Worst0, Worst1;
    float temp1, temp2;
    float beta;

    beta = tabgain[(int)AcGn];

    if(Lag <= SubFrLenS2) {
        Worst0 = exc_err[0] * beta + 1.;
        Worst1 = Worst0;
    }
    else {
        iz = Lag / SubFrLenS2;

        if((iz * SubFrLenS2) != Lag) {

            if(iz == 1) {
                Worst0 = exc_err[0] * beta + 1.;
                Worst1 = exc_err[1] * beta + 1.;
                if(Worst0 > Worst1) Worst1 = Worst0;
            }

            else {
                temp1 = exc_err[iz-2] * beta + 1.;
                temp2 = exc_err[iz-1] * beta + 1.;
                Worst0 = (temp1 > temp2) ? temp1 : temp2;
                temp1 = exc_err[iz] * beta + 1.;
                Worst1 = (temp1 > temp2) ? temp1 : temp2;
            }
        }

        /* Lag % SubFrLenS2 == 0 */
        else {
            Worst0 = exc_err[iz-2] * beta + 1.;
            Worst1 = exc_err[iz-1] * beta + 1.;
        }
    }

    for(i=SizErr-1; i>=2; i--) {
        exc_err[i] = exc_err[i-2];
    }
    exc_err[0] = Worst0;
    exc_err[1] = Worst1;
    return;
}
/*
**
** Function:      Test_Err( )
**
** Description:   Check the error excitation maximum for
**                the subframe and computes an index iTest used to
**                calculate the maximum nb of filters in the closed
**                loop long term search :
**                Bound = Min(Nmin + iTest x Pas, Nmax) , with
```

APPENDIX II-continued

```
**              AcbkGainTable085 : Pas = 2, Nmin = 51, Nmax = 85
**              AcbkGainTable170 : Pas = 4, Nmin = 93, Nmax = 170
**              iTest depends on the relative difference between
**              Err_max and a fixed threshold
**
**
** Arguments:
**
** Word16 Lag1   1st long term Lag of the tested zone
** Word16 Lag2   2nd long term Lag of the tested zone
**
** Return value:
** Word16       index itest used to compute Acbk number of filters
**
*/

int Test_Err(
    Word16 Lag1, Word16 Lag2
)
{

    int i1, i2, i, itest;
    Word16 zone1, zone2;
    float Err_max;

    i2 = Lag2 + ClpitchOrd/2;
    zone2 = i2 / SubFrLenS2;

    i1 = - SubFrLen + 1 + Lag1 - ClpitchOrd/2;
    if(i1 <= 0) i1 = 1;
    zone1 = i1 / SubFrLenS2;

    Err_max = -1.;
    for(i=zone2; i>=zone1; i—) {
        if(exc_err[i] > Err_max) {
            Err_max = exc_err[i];
        }
    }

    if(Err_max > Thresh_err) {
        itest = 0;
    }
    else {
        itest = (int)((Thresh_err - Err_max)/ (Thresh_err * Pas));
    }

    return(itest);
}
```

I claim:

1. A method of determining parameters of a pitch synthesis filter in a speech coder, comprising long-term analysis of an input speech signal to adaptively select said parameters in respective variation ranges, wherein successively selected values of said parameters are processed to estimate maximum magnitudes of an error component of an output signal of the pitch synthesis filter, and wherein the variation range of at least one of said parameters is determined on the basis of the estimated maximum magnitudes.

2. A method according to claim 1, wherein the parameters of the pitch synthesis filter are determined for each one of a succession of subframes having a length of L digitized samples of the speech signal, and wherein each subframe includes blocks of K successive samples, K being an integer at least equal to 1 and at most equal to L such that L is a multiple of K, a respective maximum magnitude of the error component being estimated for each block of a subframe after the selection of the parameters of the pitch synthesis filter relating to said subframe.

3. A method according to claim 2, wherein K>1.

4. A method according to claim 2, wherein the successive blockwise maximum magnitudes are estimated by filtering a signal of constant value by an adaptive 1-tap recursive filter which represents the pitch synthesis filter.

5. A method according to claim 2, wherein the determination of the parameters of the pitch synthesis filter for one of the subframes includes the steps of:

selecting a pitch delay as a first parameter of the pitch synthesis filter;

determining an error indicator from the largest one of the blockwise maximum magnitudes estimates relating to the blocks which contain at least one sample involved in producing at least one output value of the pitch synthesis filter having the selected pitch delay in said one of the subframes; and selecting at least one tap gain associated with the selected pitch delay as a second parameter of the pitch synthesis filter, in a domain of tap gain values which depends on the error indicator.

6. A speech coder comprising: long-term analysis means for adaptively selecting parameters of a pitch synthesis filter in respective variation ranges based on an input speech signal; and error estimation means for estimating, from successive values of said parameters, maximum magnitudes of an error component of an output signal of the pitch synthesis filter, wherein the variation range of at least one of said parameters is determined on the basis of the estimated maximum magnitudes.

7. A speech coder according to claim 6, wherein the long-term analysis means are arranged to determine the parameters of the pitch synthesis filter for each one of a succession of subframes having a length of L digitized samples of the speech signal, wherein the error estimation means are arranged to estimate a respective maximum magnitude of the error component for each one of a succession of blocks having a length of K samples, each subframe including a whole number of blocks.

8. A speech coder according to claim 7, wherein K>1.

9. A speech coder according to claim 7, wherein the error estimation means include means for filtering a signal of constant value by an adaptive 1-tap recursive filter which represents the pitch synthesis filter, so as to produce the successive blockwise maximum magnitude estimates.

10. A speech coder according to claim 7, wherein the long-term analysis means include:

means for selecting a pitch delay from a first parameter of the pitch synthesis filter for each one of the subframes;

means for determining an error indicator from the largest one of the blockwise maximum magnitudes estimates relating to the blocks which contain at least one sample involved in producing at least one output value of the pitch synthesis filter having the selected pitch delay in said one of the subframes; and means for selecting at least one tap gain associated with the selected pitch delay as a second parameter of the pitch synthesis filter, in a domain of tap gain values which depends on the error indicator.

* * * * *